US009412323B2

(12) United States Patent
Cheng et al.

(10) Patent No.: US 9,412,323 B2
(45) Date of Patent: Aug. 9, 2016

(54) POWER SAVING METHOD AND RELATED WAVEFORM-SHAPING CIRCUIT

(71) Applicant: NOVATEK Microelectronics Corp., Hsin-Chu (TW)

(72) Inventors: Chiu-Hung Cheng, Hsinchu (TW); Po-Chen Lin, Taipei (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 68 days.

(21) Appl. No.: 14/156,458

(22) Filed: Jan. 16, 2014

(65) Prior Publication Data

US 2015/0091885 A1 Apr. 2, 2015

(30) Foreign Application Priority Data

Sep. 30, 2013 (TW) ..... 102135372 A

(51) Int. Cl.
*G09G 3/36* (2006.01)
*G09G 5/00* (2006.01)

(52) U.S. Cl.
CPC ..... *G09G 3/3677* (2013.01); *G09G 2310/0213* (2013.01); *G09G 2310/06* (2013.01); *G09G 2320/0219* (2013.01); *G09G 2320/0247* (2013.01); *G09G 2330/021* (2013.01)

(58) Field of Classification Search
None
See application file for complete search history.

(56) References Cited

U.S. PATENT DOCUMENTS 6,304,243 B1 * 10/2001 Kondo et al. ..... 345/100
7,064,573 B2 * 6/2006 Fujita ..... G09G 3/006 324/750.3
8,139,056 B2 * 3/2012 Lee ..... G09G 3/3666 345/103
8,487,864 B2 * 7/2013 Itoh ..... G09G 3/3677 345/103
9,159,289 B2 * 10/2015 Han ..... G09G 3/3677
2003/0030615 A1 * 2/2003 Maeda et al. ..... 345/90
2004/0257303 A1 * 12/2004 Fujita ..... G09G 3/006 345/51
2007/0206423 A1 * 9/2007 Segami ..... H04N 3/1568 365/185.27
2009/0046085 A1 * 2/2009 Ino ..... G09G 3/3648 345/208
2009/0289884 A1 * 11/2009 Yanagi et al. ..... 345/92
2010/0141850 A1 * 6/2010 Itoh ..... G09G 3/3677 348/731
2010/0245333 A1 * 9/2010 Hsu ..... G09G 3/3648 345/213
2011/0102416 A1 * 5/2011 Hung ..... G09G 3/3677 345/213
2011/0169796 A1 * 7/2011 Guo ..... G09G 3/3677 345/208
2013/0088470 A1 * 4/2013 Chang ..... G09G 3/3655 345/208

FOREIGN PATENT DOCUMENTS

TW I253051 4/2006
TW I327716 7/2010
TW 201227664 7/2012
WO 2012119511 A1 9/2012

* cited by examiner

*Primary Examiner* — Dismery Mercedes
(74) *Attorney, Agent, or Firm* — Winston Hsu; Scott Margo

(57) ABSTRACT

The present disclosure provides a power saving method for a LCD comprising a plurality of scan lines. The power saving method comprises segregating the scan lines into a plurality of scan line groups; and individually performing a waveform-shaping function on each of the scan-line groups at different time points.

16 Claims, 14 Drawing Sheets

POWER SAVING METHOD AND RELATED WAVEFORM-SHAPING CIRCUIT

BACKGROUND OF THE INVENTION

1. Field of the Invention

The present invention relates to a power saving method and a related waveform-shaping circuit, and more particularly, to a power saving method and a related waveform-shaping circuit performing a time-division waveform-shaping function.

2. Description of the Prior Art

The advantages of a liquid crystal display (LCD) include lighter weight, less electrical consumption, and less radiation contamination. Thus, the LCD monitors have been widely applied to various portable information products, such as notebooks, PDAs, etc. The LCD monitor alters the alignment of liquid crystal molecules to control the corresponding light transmittance by changing the voltage difference between liquid crystals and provides images and produces gorgeous images with light provided by the backlight module.

Please refer to FIG. 1, which illustrates a schematic diagram of a prior art thin film transistor (TFT) LCD monitor 10. The LCD monitor 10 includes an LCD panel 122, a timing controller 102, a source driver 104, and a gate driver 106. The LCD panel 122 is constructed by two parallel substrates, and the liquid crystal molecules are filled up between these two substrates. A plurality of data lines 110, a plurality of scan lines 112 that are perpendicular to the data lines 110, and a plurality of TFTs 114 are positioned on one of the substrates. There is a common electrode installed on another substrate, and the voltage generator 108 is electrically connected to the common electrode for outputting a common voltage Vcom via the common electrode. Please note that only four TFTs 114 are shown in FIG. 1 for clarity. Actually, the LCD panel 122 has one TFT 114 installed in each intersection of the data lines 110 and scan lines 112. In other words, the TFTs 114 are arranged in a matrix format on the LCD panel 122. The data lines 110 correspond to different columns, and the scan lines 112 correspond to different rows. The LCD monitor 10 uses a specific column and a specific row to locate the associated TFT 114 that corresponds to a pixel. In addition, the two parallel substrates of the LCD panel 122 filled up with liquid crystal molecules can be considered as an equivalent capacitor 116.

The operation of the prior art LCD monitor 10 is described as follows. First, the timing controller 102 generates data signals corresponding to the images and a timing control signal and a clock signal corresponding control signals for the LCD panel 122. The source driver 104 and the gate driver 106 then drive different data lines 110 and scan lines 112 according to the signals sent by the timing controller 102, thereby turning on the corresponding TFTs 114 and controlling the voltage differences in the equivalent capacitor 11, and further changing the alignment of liquid crystal molecules and light transmittance. For example, the gate driver 106 outputs a pulse to the scan line 112 for turning on the TFT 114. Therefore, the voltage of the input signal generated by the source driver 104 is inputted into the equivalent capacitor 116 through the data line 110 and the TFT 114. The voltage difference kept by the equivalent capacitor 116 can then adjust a corresponding gray level of the related pixel through affecting the related alignment of liquid crystal molecules positioned between the two parallel substrates. In addition, the source driver 104 generates the input signals, and magnitude of each input signal inputted to the data line 110 is corresponding to different gray levels.

When the TFTs 114 is charged, the voltage drops from a high voltage level Vgh to a low voltage level Vgl on driving signals generated by the gate driver 106 causes a feed-through effect, which makes the voltage levels in pixels lower than it is supposed to be. If the voltage difference due to the feed-through effect is large, the flicker occurs while displaying. One solution to the flicker caused by the feed-through effect is to generate a shaped-waveform on the driving signals. The advantage of the shaped-waveform is that the feed-through effect can be reduced since the abrupt voltage drop from the high voltage level Vgh to the low voltage level Vgl becomes smaller.

However, the waveform-shaping circuit in the gate driver 106 works when the power supply thereof charges and discharges regulation capacitor in turns, which consumes a lot of power. Use of a power management chip to switch high voltage level on the driving signals would be an alternative. Still, the power consumption is inevitable since continuous charging and discharging the gate driver 106 is involved.

SUMMARY OF THE INVENTION

It's therefore an objective of the present invention to provide a power saving method for a liquid crystal display (LCD).

The present invention discloses a power saving method for a LCD comprising a plurality of scan lines. The power saving method comprises segregating the scan lines into a plurality of scan line groups; and individually performing a waveform-shaping function on each of the scan-line groups at different time points.

The present invention further discloses an LCD. The LCD comprises a plurality of scan-line groups, wherein each of the scan-line groups comprises a plurality of scan lines, a plurality of waveform-shaping circuits for individually performing a waveform-shaping function on each of the scan-line groups at different time points. Each of the waveform-shaping circuits is coupled to one of the scan-line groups and comprises a waveform-shaping unit for performing the waveform-shaping function; and a control logic unit coupled to the waveform-shaping unit, for controlling the waveform-shaping unit to perform the waveform-shaping function.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
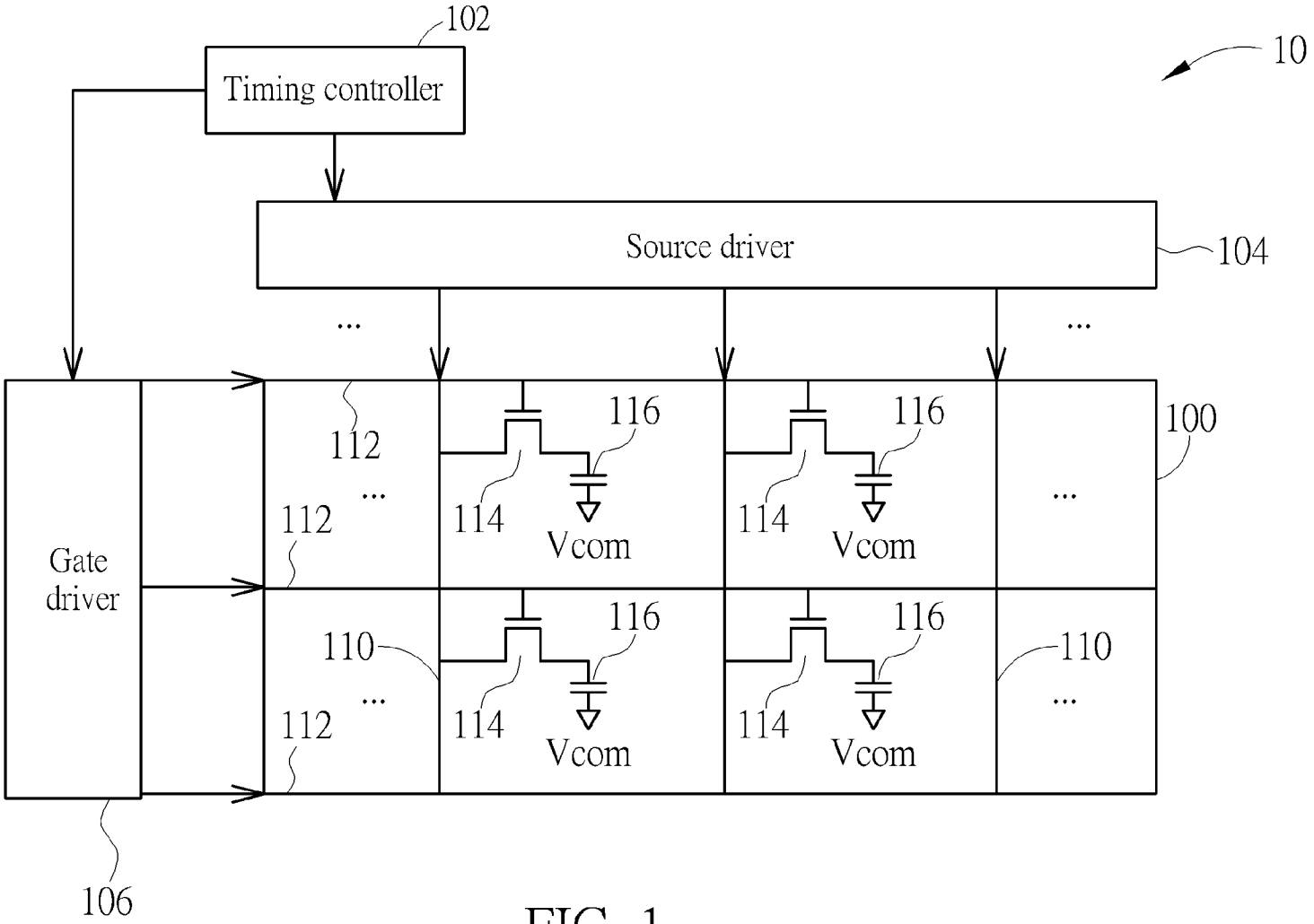
FIG. 1 illustrates a schematic diagram of a prior art TFT LCD monitor.
Figure 2:
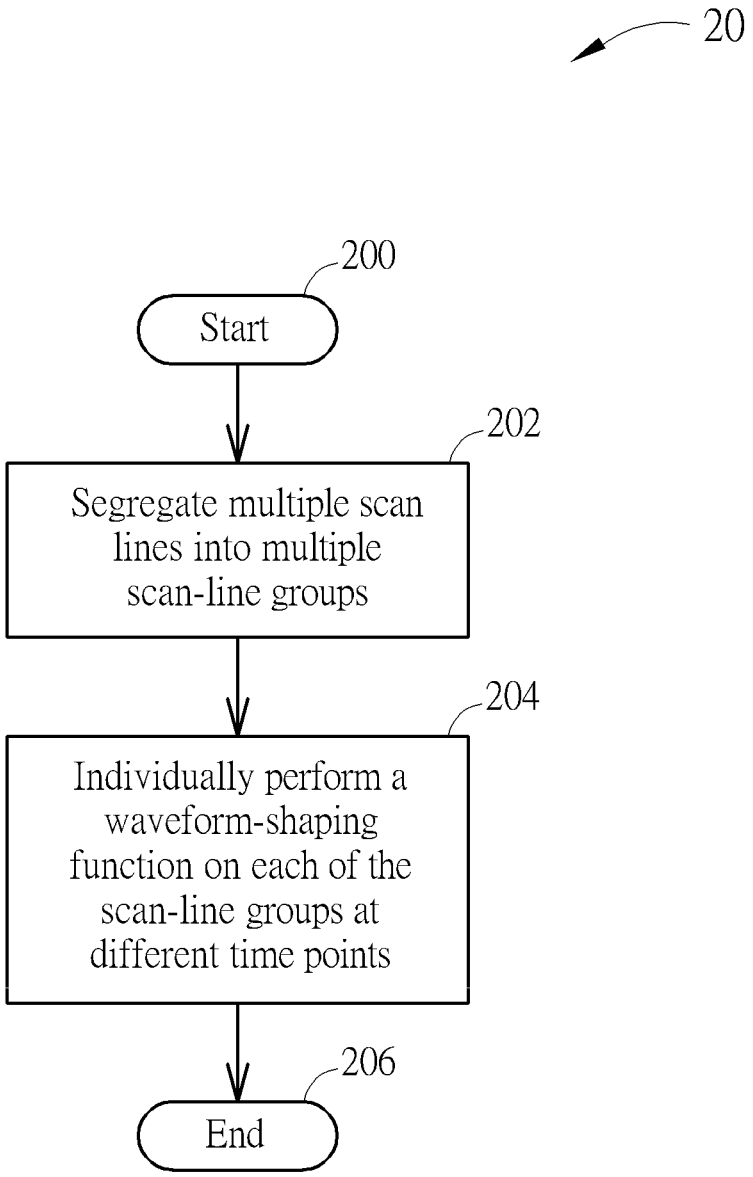
FIG. 2 is an exemplary flow chart of a power saving process for an LCD.

Please refer to FIG. 2, which is an exemplary flow chart of a power saving process 20 for a liquid crystal display (LCD). The LCD includes multiple scan lines. The power saving process 20 is used for reducing a feed-through effect and power consumption. The power saving process 20 includes the following steps:

Step 200: Start.

Step 202: Segregate multiple scan lines into multiple scan-line groups.

Step 204: Individually perform a waveform-shaping function on each of the scan-line groups at different time points.

Step 206: End.

According to the power saving process, each of the scan-line groups performs the waveform-shaping function at the different time points. In other words, only one scan-line group at a time is allowed to perform the waveform-shaping function. The waveform-shaping function is used for the LCD and allows the LCD to shape the waveform of the driving signals, reducing the flickers caused by the feed-through effect. Since the power saving process 20 makes each of the scan-line groups perform the waveform-shaping function in turn, this avoids the charge/discharge loading caused by more than one scan-line groups performing the waveform-shaping together. Further, the power consumption can be reduced. Therefore, the exemplary power saving process 20 can reduce the power consumption while the LCD is performing the waveform-shaping function.

Figure 3:
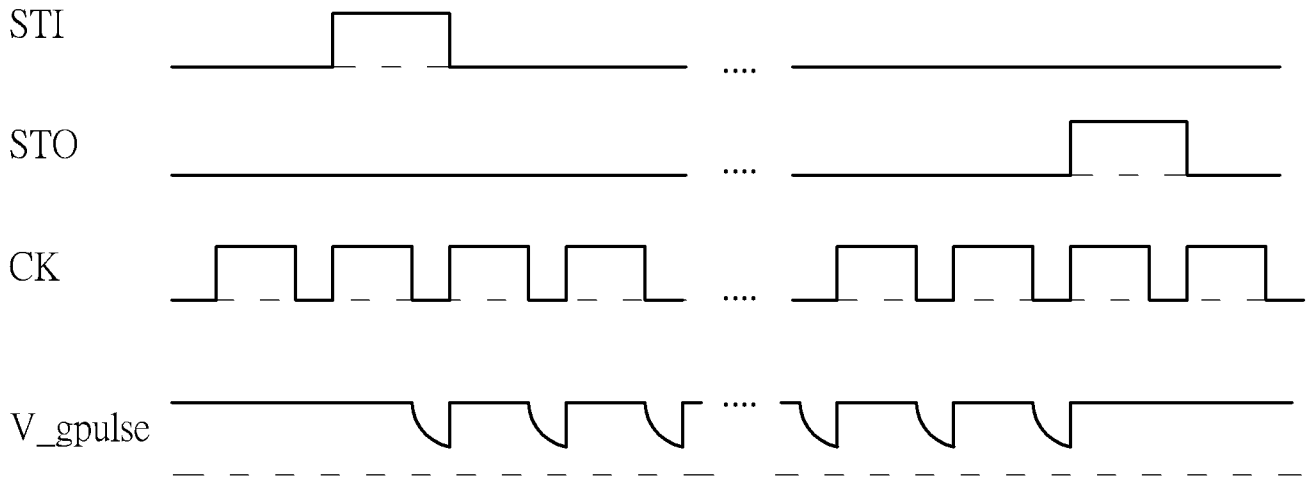
FIG. 3 is an exemplary sequence diagram when the waveform-shaping function is enabled and disabled.

The waveform-shaping function can be disabled or enabled according to an input start pulse STI, an output start pulse STO and a clock signal CK. Please refer to FIG. 3, which is an exemplary sequence diagram when the waveform-shaping function is enabled and disabled. As shown in FIG. 3, the waveform-shaping function is enabled at the falling edge of the clock signal CK when the input start pulse STI is coming. At that moment, the waveform edge of the driving signal V_gpulse is shaped. The waveform-shaping function is disabled when the output start pulse STO is coming. On the other hand, by using different clock signals each of the scan-line groups can perform the waveform-shaping function individually at the different time points. For example, a scan-line group G1 performs the waveform-shaping function according to the input start pulse STI and a clock signal CKD(1) while a scan-line group G2 performs the waveform-shaping function according to the input start pulse and a clock signal CKD(2). Namely, through different clock signals, each of the scan-line groups can perform the waveform-shaping function individually at the different time points. In an example of the present disclosure, the clock signals CKD(1) and CKD(2) are generated by dividing the clock signal CK.

Further, the way to segregate the scan lines into scan-line groups includes at least one of the follows: segregating the scan lines into the scan-lie groups according to the gate drivers, a scan-line order or a scan-line quantity. For example, the LCD includes the multiple scan lines, the scan lines are segregated into scan-line groups according to the gate drivers, each of the scan-line groups corresponding to one gate driver. Namely, at a certain time point only one single gate driver enables the waveform-shaping function. The waveform-shaping function is disabled for the other gate drivers so that each scan-line group takes turn to perform the waveform-shaping function, preventing all gate drivers from performing the waveform-shaping function at the same time. Thus, the power consumption can be achieved. In some examples, the power saving process 20 is not limited to multiple gate drivers. It also can be applied to a single gate driver with multiple scan lines. In this situation, the scan lines of the gate driver are segregated into different scan-line groups according to a scan-line order or a specific quantity of the scan lines. For example, a gate driver includes n scan lines g(1), g(2), g(3), . . . , g(n) and k adjacent scan lines can be grouped together. Thus, the scan lines g(1), g(2), g(3), . . . , g(n) are segregated into n/k groups (i.e. scan-line groups G_1, G_2, . . . G_n/k). The scan-line group G_1 includes the scan lines g(1), g(2), . . . , g(k); the scan-line group G_2 includes the scan lines g(k+1), g(k+2), g(k+3), . . . , g(2k), and so on. In some examples, the scan lines g(1), g(2), g(3), . . . , g(n) are grouped together every p scan lines. Namely, the scan-line group G1 includes the scan lines g(1), g(1+p), g(1+2p) . . . , and the scan-line group G_2 includes g(2), g(2+p), g(2+2p), . . . , and so on. When p=2, it represents the even scan lines are grouped together while the odd scan lines are grouped together. In addition, two grouping rules can be combined. The scan lines are segregated into m scan-line groups first and the scan lines in each scan-line group are segregated into an even sub-group and an odd sub-group. Or the scan lines are segregated into an even scan-line group and an scan-line odd group first. Then the scan lines in the odd group are segregated into m1 scan-line sub-groups and the scan lines in the even group are segregated into m2 scan-line sub-groups.

Figure 4:
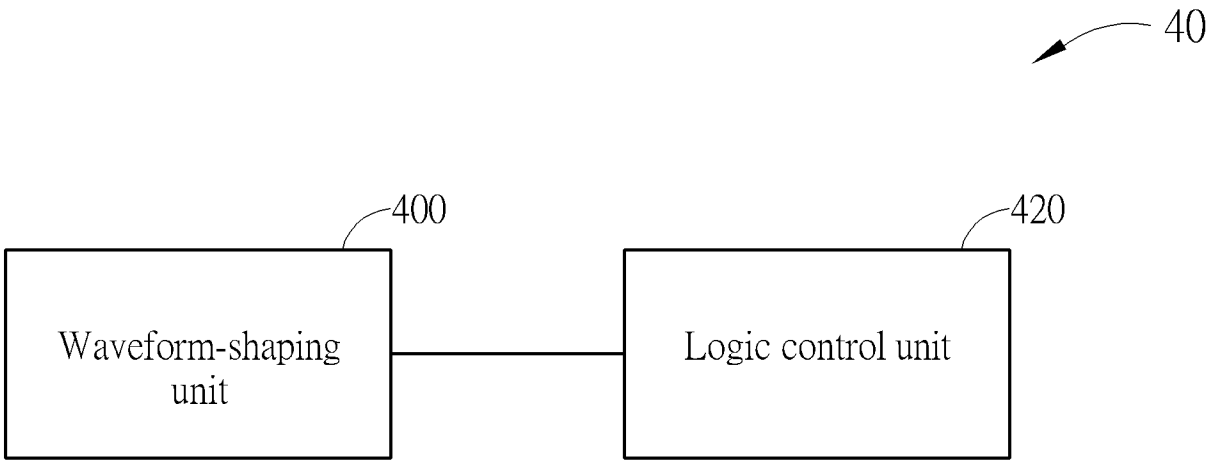
FIG. 4 is a schematic diagram of an exemplary time-division waveform-shaping circuit.
Figure 5:
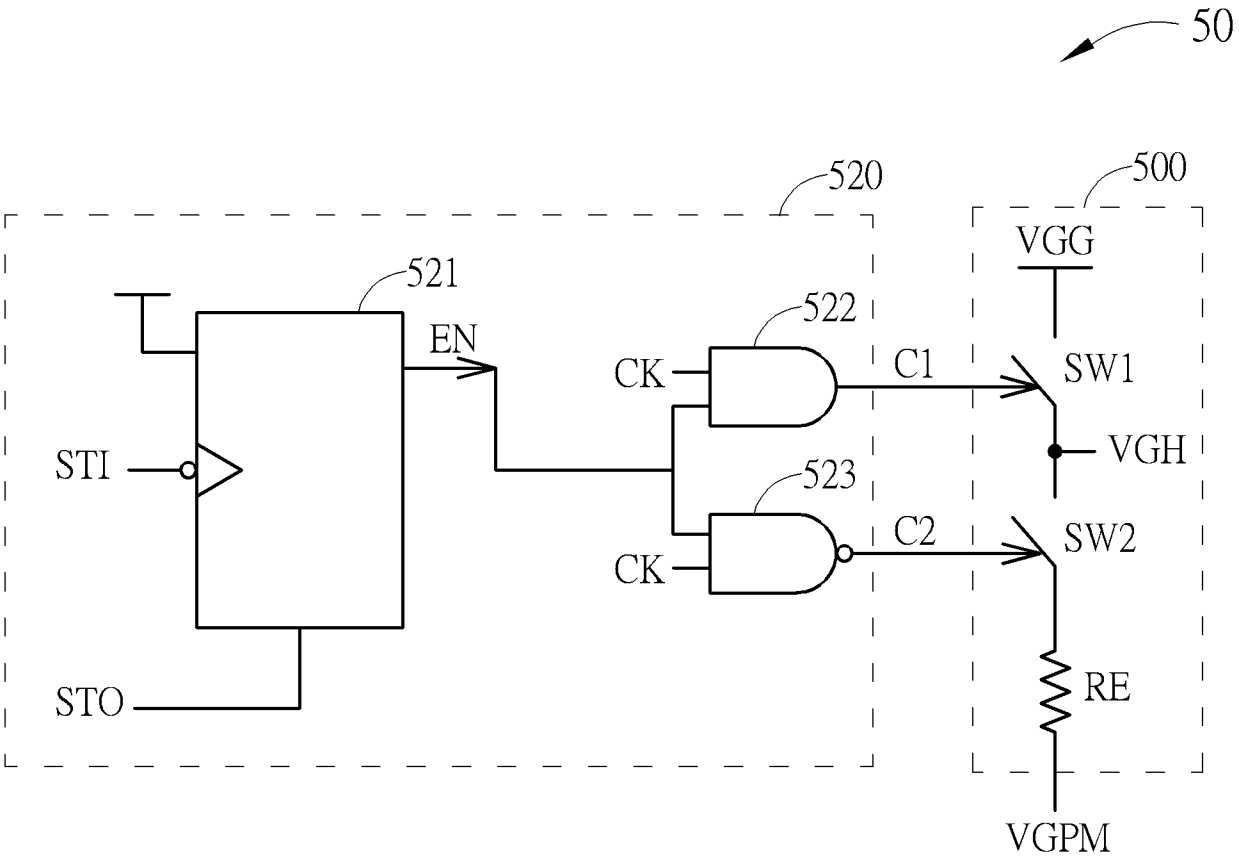
FIG. 5 is a schematic diagram of a time-division waveform-shaping circuit.

Please refer to FIG. 4, which is a schematic diagram of an exemplary time-division waveform-shaping circuit 40. The time-division waveform-shaping circuit 40 can be used in a LCD for performing a waveform shaping function, thereby reducing power consumption. The time-division waveform-shaping circuit 40 includes a waveform-shaping unit 400 and a logic control unit 420. The waveform-shaping unit 400 is used for performing the waveform-shaping function. The control logic 420 is coupled to the waveform-shaping unit 400 and used for enabling the waveform-shaping function. The implementation of the waveform shaping unit 400 and the logic control unit 420 can be referred to FIG. 5. FIG. 5 is a schematic diagram of a time-division waveform-shaping circuit 50. The time-division waveform-shaping circuit 50 can implement the time-division waveform-shaping circuit 40. The time-division waveform-shaping circuit 50 includes a waveform-shaping unit 500 and a control logic unit 520. The control logic unit 520 includes a flip-flop 521, a AND gate 522 and a NAND gate 523. The flip-flop 521 has a first input terminal for receiving an input start pulse STI, a second input terminal for receiving an output start pulse STO and an output terminal for outputting an enable signal EN. The input start pulse STI and the output start pulse are used for enabling and disabling the waveform-shaping function, respectively. The AND gate 522 has a first input terminal for receiving the enable signal EN, a second input terminal for receiving a clock signal CK and an output terminal for outputting a switching control signal C1. The NAND gate 523 has a first input terminal for receiving the enable signal EN, a second input terminal for receiving the clock signal CK and an output terminal for outputting a switching control signal C2. The switching control signals C1 and C2 are used for controlling the waveform-shaping unit 500 to perform the waveform-shaping function. Switches SW1 and SW2 are implemented by two transistors and the resistance element RE is implemented by a resistor. Besides, in other examples the resistance element RE can be replaced by a current source in implementation of the waveform-shaping unit 500.

Figure 6:
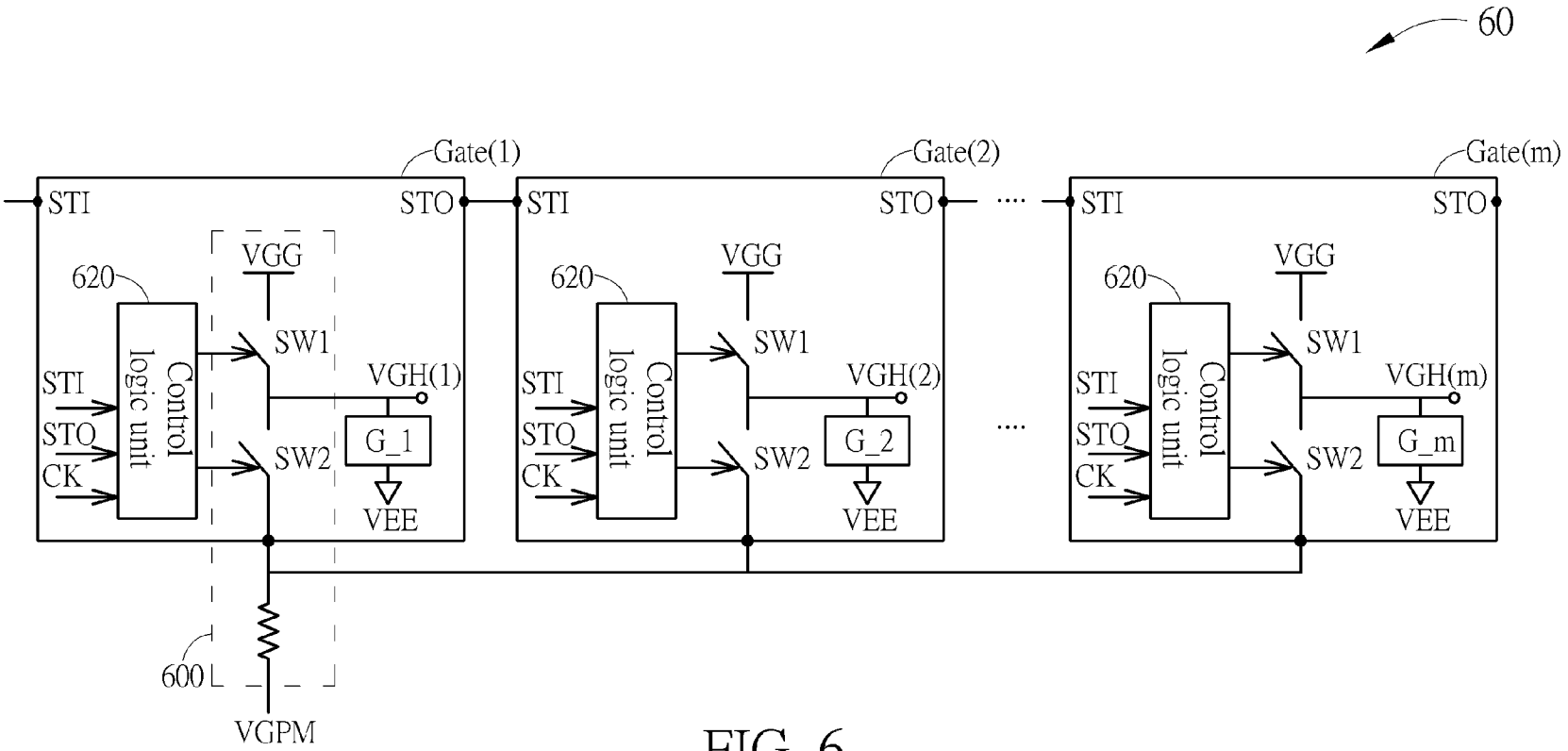
FIG. 6 is an implementation circuit with multiple gate drivers for the power saving process 20.

Please refer to FIG. 6, which is an implementation circuit 60 with multiple gate drivers for the power saving process 20. For simplicity, only some essential elements are shown in the implementation circuit 60. The implementation circuit 60 includes multiple waveform-shaping units 600 and multiple control logic units 620. Each of the waveform-shaping units 600 includes switches SW1 and SW2 and shares a resistance element RE. The implementation circuit 60 segregates the multiple scan lines into scan-line groups G_1, G_2, . . . , G_m according to gate driver Gate(1), Gate(2), . . . , Gate(m). Each scan-line group is coupled to one of the control logic units 620 and one of the waveform-shaping units 600. Each control logic unit has 3 input terminals for receiving an input start pulse STI, an output start pulse STO and a clock signal CK, respectively, and controls the switches SW1 and SW2 according to the input start pulse STI, the output start pulse STO and the clock signal CK. The waveform-shaping units 600 are coupled to a voltage source VGG and a target voltage level VGPM, and individually coupled to the scan lines in each of scan-lines groups to provide a high voltage level VGH(x) and a low voltage level VEE to each scan-line group, where, x=1, 2, 3, . . . , m. When the input start pulse is coming, the control logic units 620 enable the waveform-shaping function on the gate drivers Gate(1), Gate(2), . . . , Gate(m) sequentially. Only one gate driver performs the waveform-shaping function at a certain time point, preventing all the gate driver from performing the waveform-shaping functions at the same time, and further achieving power saving.

Figure 7:
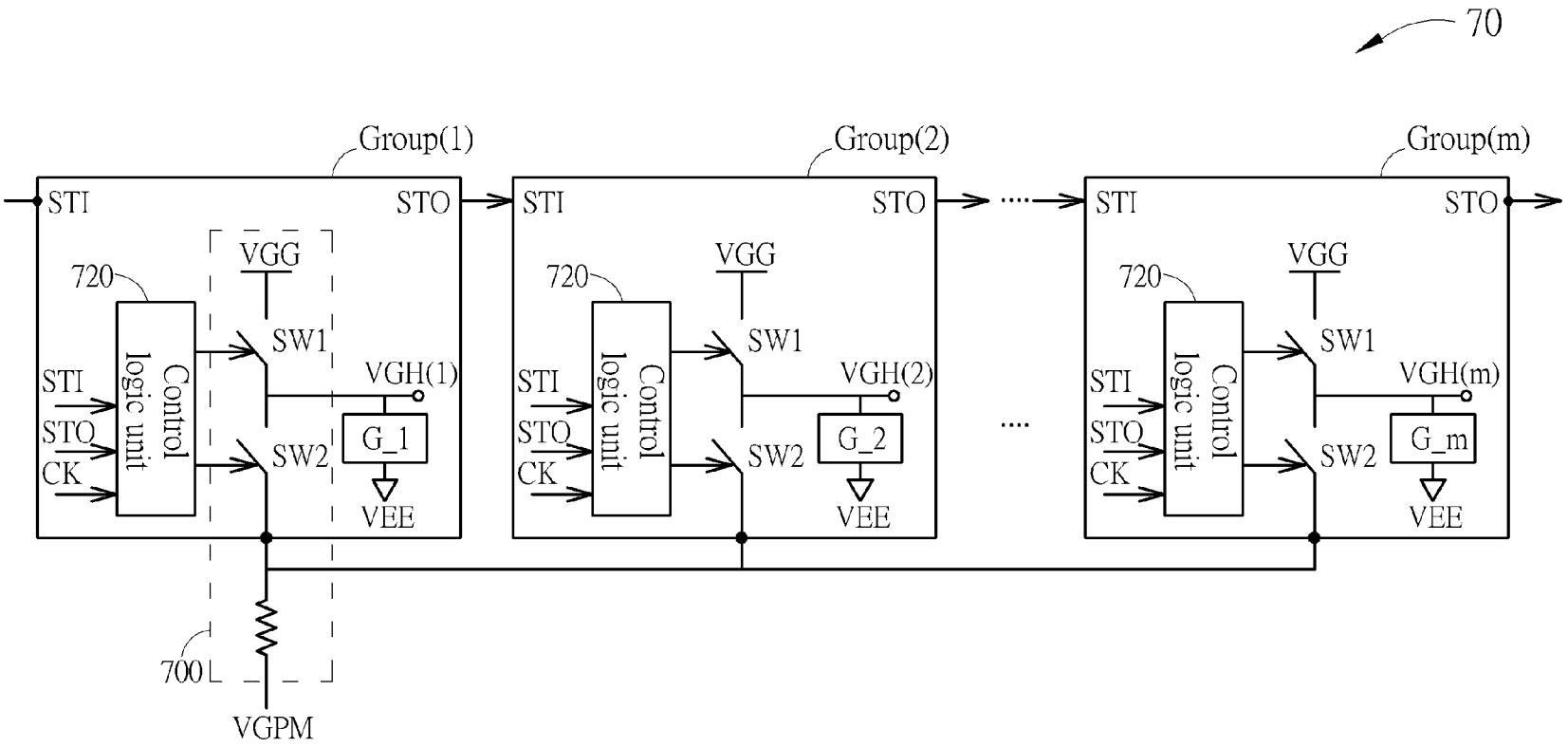
FIG. 7 is another implementation circuit with multiple groups in one gate driver for the power saving process 20.

Please refer to FIG. 7, which is another implementation circuit 70 with multiple groups in one gate driver for the power saving process 20. For simplicity, only essential elements are shown in the implementation circuit 70. The implementation circuit 70 can be used in a single gate driver and includes multiple waveform-shaping units 700 and multiple control logic units 720. Each of the waveform-shaping units 700 includes switches SW1 and SW2 and shares a resistance element RE. The implementation circuit 70 segregates the scan lines (not shown in FIG. 7) into m scan-line groups (i.e. scan-line groups G_1, G_2, . . . , G_m) according to a specific quantity of the adjacent scan lines (e.g. k adjacent scan lines are grouped together). Each of the scan-line groups is coupled to one of the control logic units 720 and one of the waveform-shaping units 700. Each control logic unit has 3 input terminals for receiving an input start pulse STI, an output start pulse STO and a clock signal CK, respectively, and controls the switches SW1 and SW2 according to the input start pulse STI, the output start pulse STO and the clock signal CK. The waveform-shaping units 700 are coupled to a voltage source VGG and a target voltage level VGPM, and each of the waveform-shaping units 700 is individually coupled to one of the scan-line groups to provide a high voltage level VGH (x) and a low voltage level VEE for each scan-line group, wherein x=1, 2, 3, . . . , m. When the input start pulse STI is coming, the control logic units 720 enable the waveform-shaping function on the scan-line groups G_1, G_2, . . . , G_m, in turn. This allows only one scan-line group at a time to perform the waveform-shaping function, preventing all the scan-line groups from performing the waveform-shaping function together. Further, power saving can be achieved.

Figure 8:
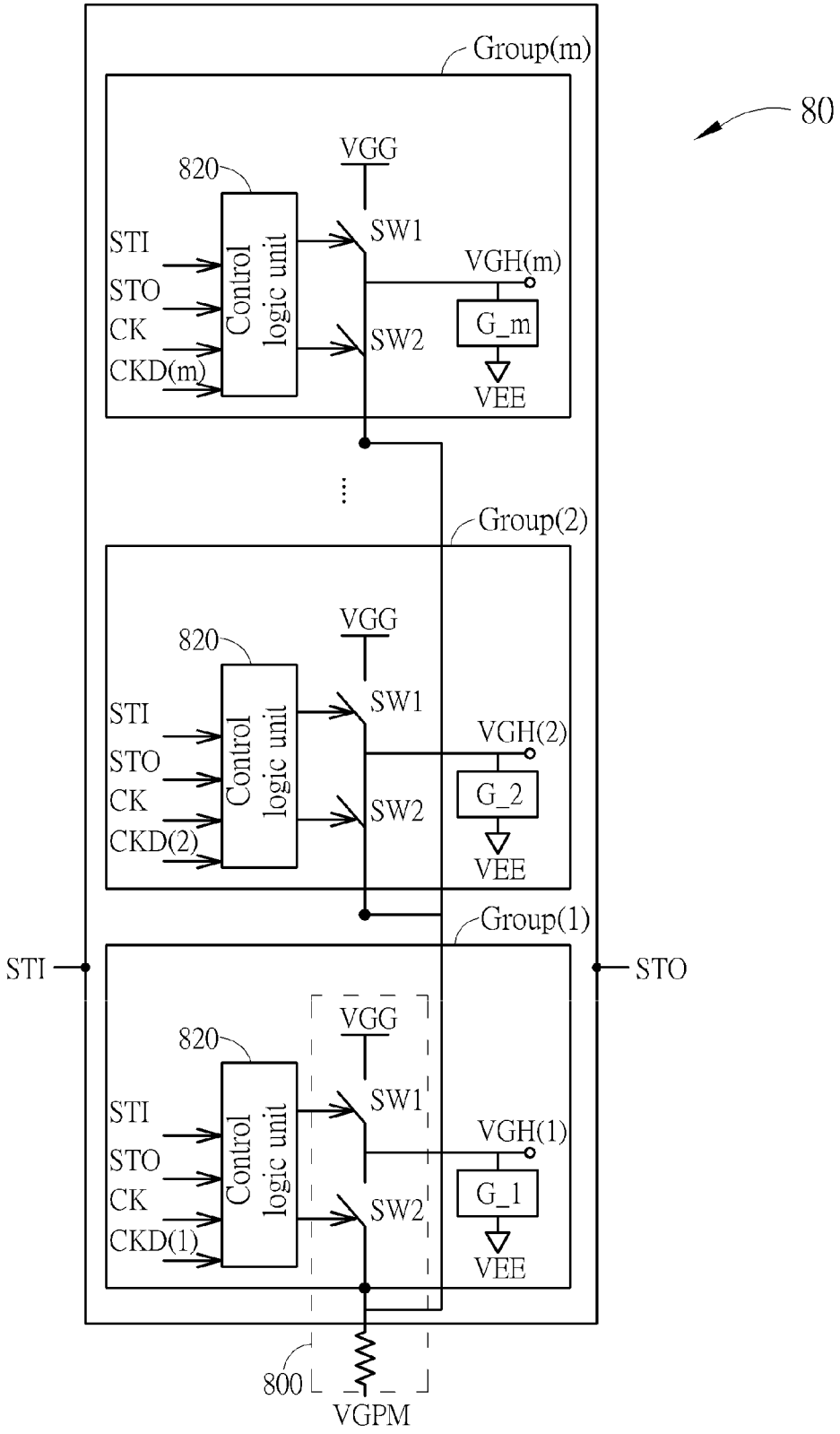
FIG. 8 is an implementation circuit with multiple groups in one gate driver for the power saving process 20.

Please refer to FIG. 8, which is an implementation circuit 80 with multiple groups in one gate driver for the power saving process 20. For simplicity, only essential elements are shown in the implementation circuit 80. The implementation circuit 80 can be used in a single gate driver and includes multiple waveform-shaping units 800 and multiple control logic units 820. Each of the waveform-shaping units 800 includes switches SW1 and SW2 and shares a resistance element RE. The implementation circuit 80 segregates the scan lines (not shown in FIG. 8) into m scan-line groups (i.e. scan-line groups G_1, G_2, . . . , G_m) according to a specific scan-line order (e.g. every k scan lines are grouped together). Each of the scan-line groups is coupled to one of the control logic units 820 and one of the waveform-shaping units 800. Each control logic unit has 4 input terminals for receiving an input start pulse STI, an output start pulse STO, a clock signal CK and a clock signal CKD(x), respectively, where, x=1, 2, . . . , m. The waveform-shaping units 800 are coupled to a voltage source VGG and a target voltage level VGPM, and each of the waveform-shaping units 800 is individually coupled to one of the scan-line groups to provide a high voltage level VGH(x) and a low voltage level VEE for each scan-line group, wherein x=1, 2, 3, . . . , m. Via different the clock signals CKD(x), where x=1, 2, 3, . . . , m, the control logic units 820 staggers the times that scan-line groups G_1, G_2, . . . , G_m perform the waveform-shaping function, preventing all the scan-line groups from performing the waveform-shaping function together. Further, power saving can be achieved.

Figure 9A:
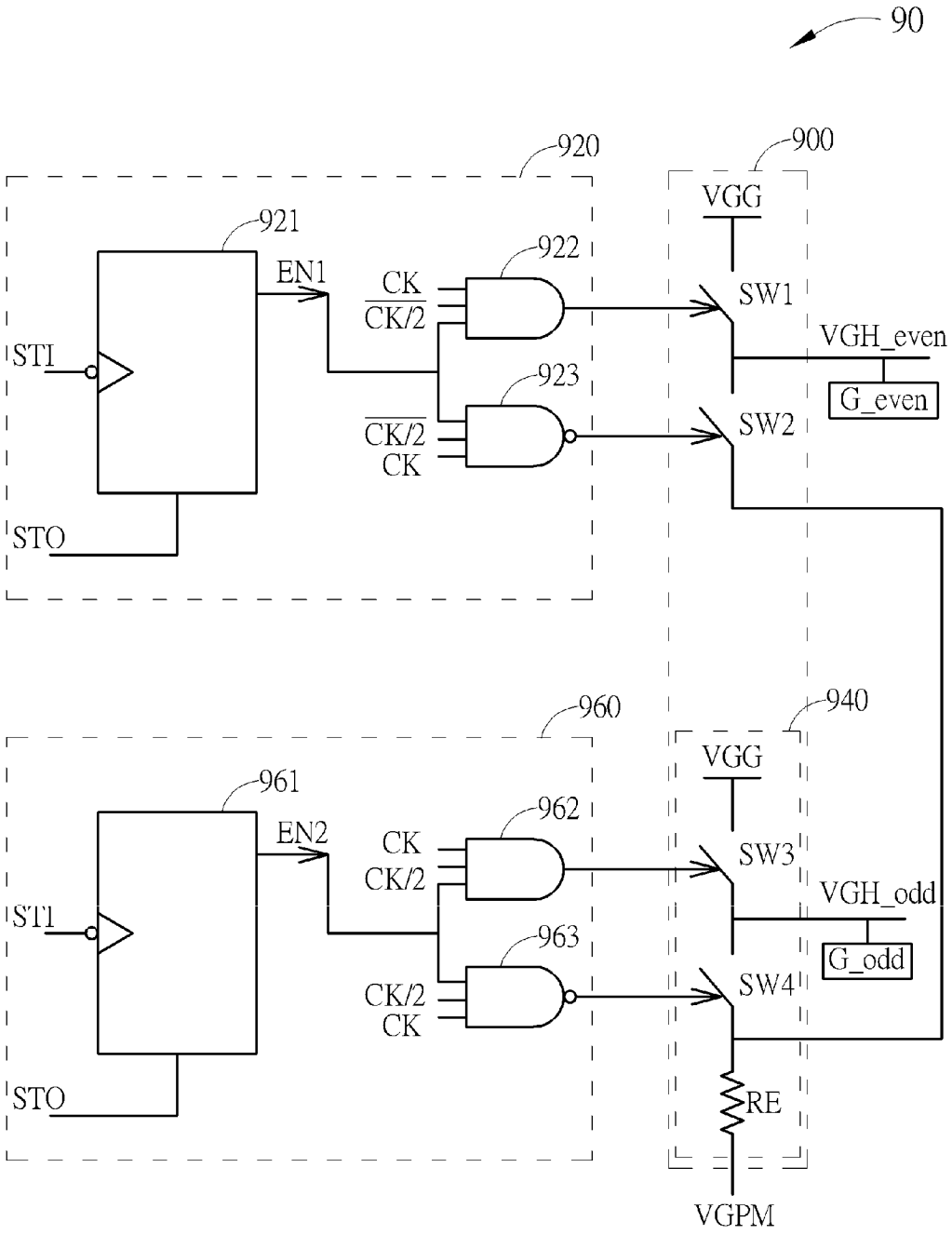
FIG. 9(A) is an implementation circuit for the power saving process 20.
Figure 9B:
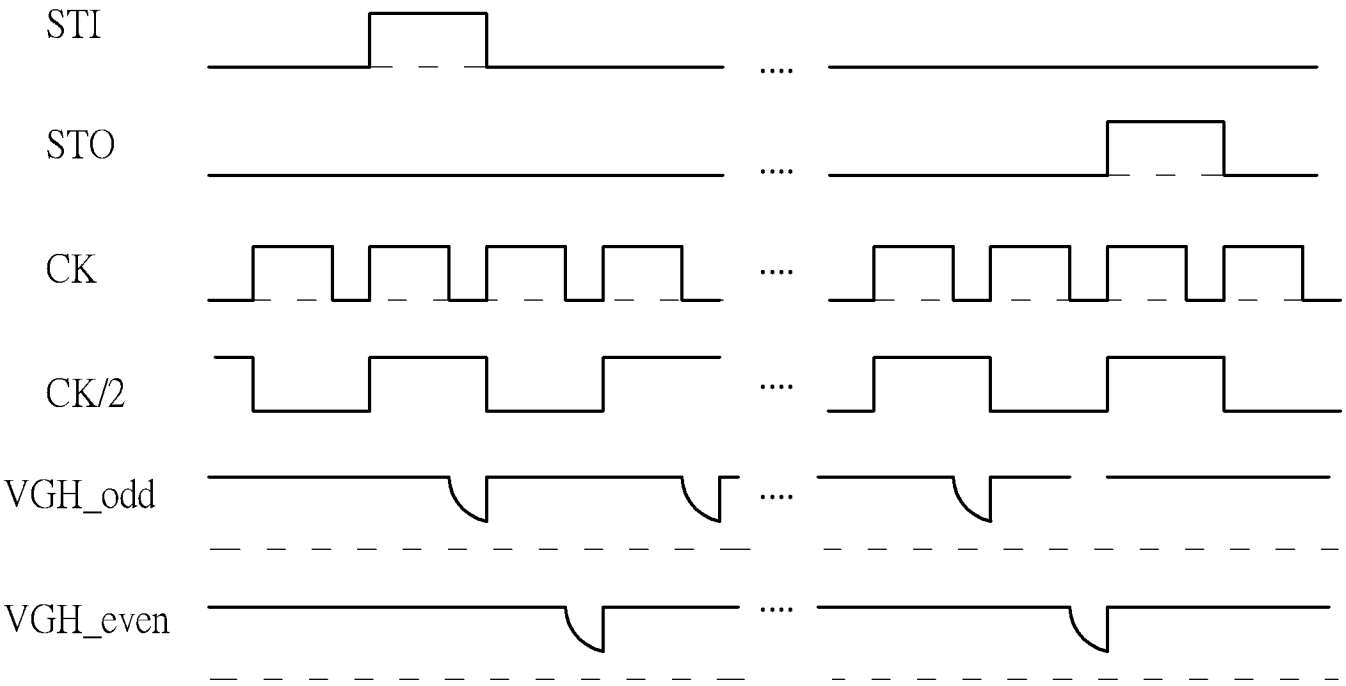
FIG. 9(B) is a waveform diagram of FIG. 9(A).

Please refer to FIGS. 9(A) and 9(B), FIG. 9(A) is an implementation circuit 90 for the power saving process 20 and FIG. 9(B) is a waveform diagram of FIG. 9(A). The implementation circuit 90 can be used in an LCD for staggering the times that an odd scan-line group G_odd and an even scan-line group G_even perform the waveform-shaping function. The implementation 90 includes a first waveform-shaping unit 900, a first control logic unit 920, a second waveform-shaping unit 940 and a second control logic unit 960. The first waveform-shaping unit 900 is coupled to a voltage source VGG, a target voltage level VGPM, and the scan lines in the even scan-line group G_even, to provide the even scan-line group a high voltage level VGH even. The first waveform-shaping unit 900 includes switches SW1 and SW2 and shares a resistance element RE with the second waveform-shaping unit 940. The first control logic unit 920 includes a flip-flop 921, an AND gate 922 and a NAND gate 923. The flip-flop 921 has a first input terminal for receiving an input start pulse STI, a second input terminal for receiving an output start pulse STO and an output terminal for outputting an enable signal EN1. The AND gate 922 has a first input terminal for receiving the enable signal EN1, a second input terminal for receiving a first clock signal CK, a third input signal for receiving a second clock signal $\overline{CK/2}$ and an output terminal for turning on/off the switch SW1. The NAND gate 923 has a first input terminal for receiving the enable signal EN1, a second input terminal for receiving the first clock signal CK, a third input terminal for receiving the second clock signal $\overline{CK/2}$ and an output terminal for turning on/off the switch SW2. The second clock signal $\overline{CK/2}$ is generated by dividing the first clock signal CK and then reversing the divided clock signal. The second waveform-shaping unit 940 is coupled to the voltage source VGG, the target voltage level VGPM and the scan lines in the odd scan-line group G_odd, to provide the odd scan-line group a high voltage VGH_odd. The second waveform-shaping unit 940 includes switches SW3 and SW4 and shares the resistance element RE with the first waveform-shaping unit 900. The second control logic unit 960 includes a flip-flop 961, an AND gate 926 and a NAND gate 963. The flip-flop 961 has a first input terminal for receiving the start input pulse STI, a second input terminal for receiving the output start pulse STO and an output terminal for outputting an enable signal EN2. The AND gate 962 has a first input terminal for receiving the enable signal EN2, a second input terminal for receiving the clock signal CK, a third input terminal for receiving a third clock signal CK/2 and an output terminal for turning on/off the switch SW3. The NAND gate 963 has a first input terminal for receiving the enable signal EN2, a second input terminal for receiving the clock signal CK, a third input signal for receiving the third clock signal CK/2 and an output terminal for turning on/off the switch SW4. The third clock signal CK/2 is generated by dividing the clock signal CK. When the input start pulse is coming, the waveform-shaping unit 900 and the waveform-shaping unit 940 perform the waveform-shaping function on the even scan-line group G_even and the odd scan-line group G_odd according to the second clock signal $\overline{CK/2}$ and the third clock signal CK/2, respectively.

Figure 10A:
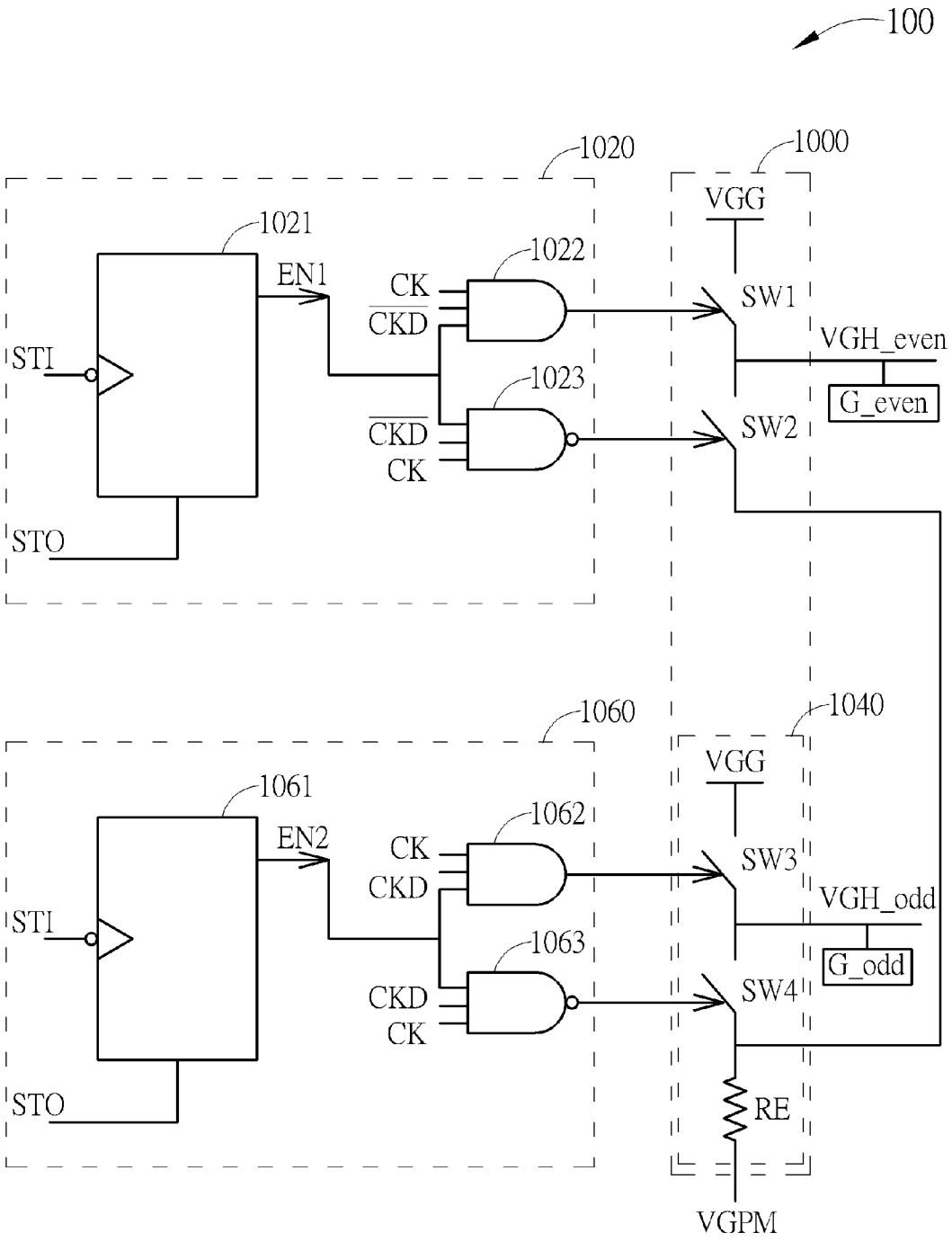
FIG. 10(A) is an implementation circuit for the power saving process 20.
Figure 10B:
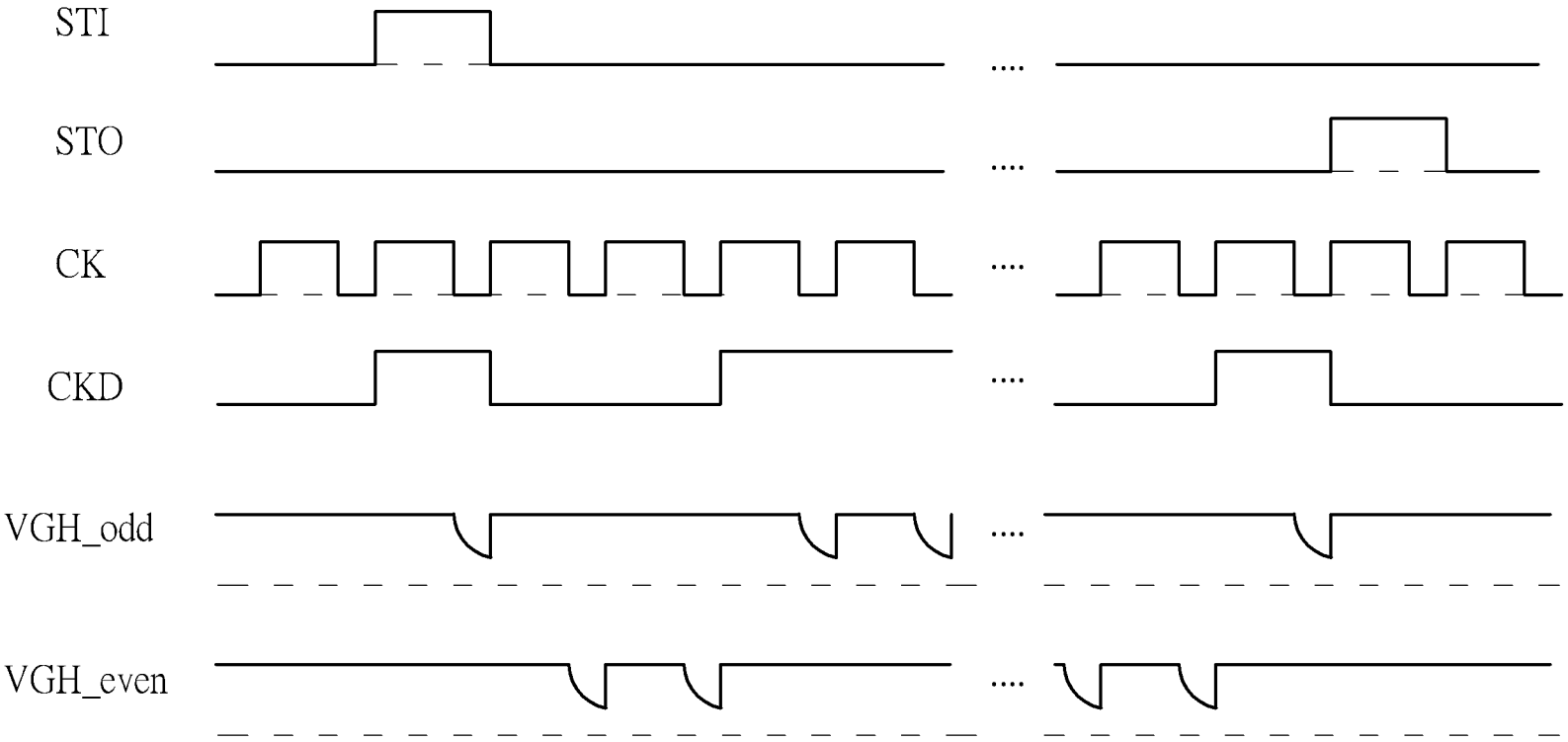
FIG. 10(B) is a waveform diagram of FIG. 9(A).

On the other hand, the waveform-shaping function can be performed on scan lines in an arbitrary order by controlling the second clock signal and the third clock signal. Please refer to FIGS. 10(A) and 10(B), FIG. 10(A) is an exemplary schematic diagram of an implementation circuit 100 and FIG. 10(B) is a waveform diagram of FIG. 10(A). The implementation 100 is a variation of the implementation 90. Basically, the circuit structure of the implementation 100 is similar to the one of the implementation 90 so that the same reference number indicates identical or functionally similar elements, and therefore the detailed description thereof is omitted herein. The only difference is a clock signal CKD in the implementation 100. By controlling the clock signal CKD, the even scan-line group G_even and the odd scan-line group G_odd can perform the waveform-shaping function in turn. The waveform-shaping function is perform in the order: g(1), g(2), g4), g(3), g(5), g(6), g(8), g(7).

Figure 11A:
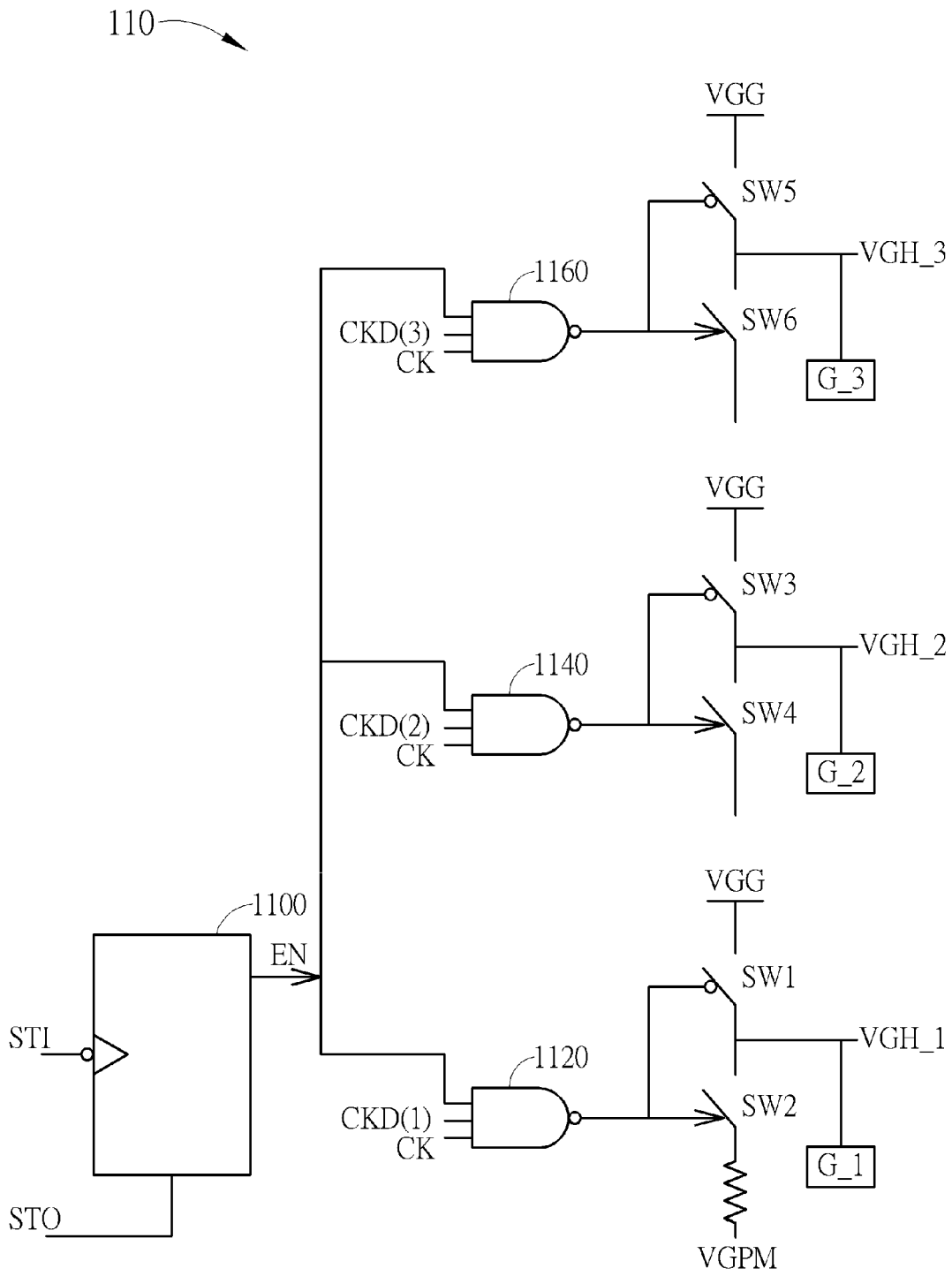
FIG. 11(A) is an implementation circuit for the power saving process 20.
Figure 11B:
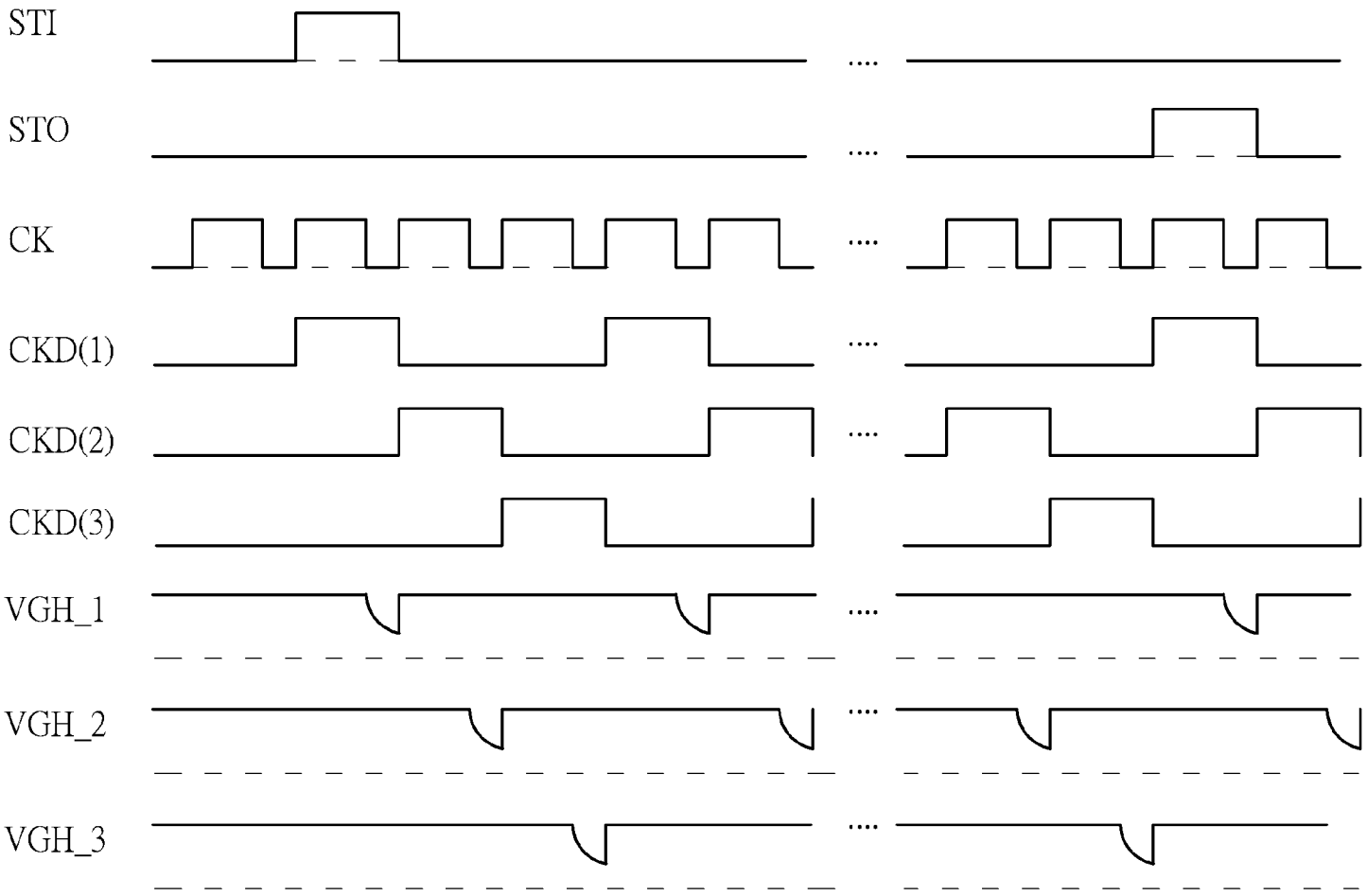
FIG. 11(B) is a waveform diagram of FIG. 9(A).

Please refer to FIGS. 11(A) and 11(B), FIG. 11(A) is a schematic diagram of an implementation circuit 110 and FIG. 11(B) is a waveform diagram of FIG. 11(A). The implementation circuit 110 includes a flip-flop 1100, NAND gates 1120, 1140 and 1160, switches SW1, SW2, SW3, SW4, SW5 and SW6, and a resistance element RE. In the implementation circuit 110, every 3 scan lines (not shown in FIG. 11(A)) are grouped together, forming the scan-line groups G_1, G_2 and G_3. The scan-line group G_1 includes the scan lines g(1), g(4), g(7), . . . ; the scan-line group G_2 includes the scan lines g(2), g(5), g(8), . . . ; the scan-line group G_3 includes the scan lines g(3), g(6), g(9), . . . . The flip-flop 1100 has a first input terminal for receiving a start input pulse, a second input terminal for receiving an output start pulse and an output terminal for outputting an enable signal EN. The NAND gate 1120 has a first input terminal for receiving the enable signal EN, a second input terminal for receiving a first clock signal CK, a third input signal for receiving a second clock signal CKD(1) and an output terminal for turning on/off the switches SW1 and SW2. The NAND gate 1140 has a first input terminal for receiving the enable signal EN, a second input terminal for receiving the first clock signal CK, a third input terminal for receiving a third clock signal CKD(2) and an output terminal for turning on/off the switches SW3 and SW4. The NAND gate 1160 has an first input terminal for receiving the enable signal EN, a second input terminal for receiving the first clock signal CK, a third input terminal for receiving a forth clock signal CKD(3) and an output terminal for turning on/off the switches SW5 and SW6. The switches SW1, SW2, SW3, SW4, SW5 and SW6 are individually coupled to the scan-line groups G_1, G_2 and G_3. When the start input pulse STI is coming, the different clock signals CKD(1), CKD(2) and CKD(3) are used to perform the waveform-shaping function on the scan-line groups G_1, G_2 and G_3 individually.

Please note that all the flip-flop abovementioned can be implemented by a D flip flop.

To sum up, the examples of the present disclosure segregate the scan lines in a LCD into different scan-line groups and perform the waveform-shaping function on each of the scan-line groups at different times. This prevents all the scan-line groups from performing the waveform-shaping function at the same time, achieving power saving.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A power saving method for a liquid crystal display (LCD), the LCD comprising a plurality of scan lines, the power saving method comprising:

segregating the scan lines into a plurality of scan-line groups comprising a first scan-line group and a second scan-line group; and individually performing a waveform-shaping function on each of the scan-line groups at different time points by a plurality of waveform-shaping circuits each coupled to one of the scan-line groups, wherein the waveform-shaping circuits comprise a first waveform-shaping circuit corresponding to the first scan-line group and a second waveform-shaping circuit corresponding to the second scan-line group, the waveform-shaping function performed on the first scan-line group is being disabled by the first waveform-shaping circuit according to a second timing control signal, and the waveform-shaping function performed on the second scan-line group is being enabled by the second waveform-shaping circuit according to a first timing control signal;

wherein the second timing control signal according to which the waveform-shaping function of the first scan-line group is disabled is transmitted from the first waveform-shaping circuit to the second waveform-shaping circuit to serve as the first timing control signal according to which the waveform-shaping function of the second scan-line group is enabled.

2. The power saving method of claim 1, wherein the step of individually performing the waveform-shaping function on each of the scan-line groups at the different time points comprises:

performing the waveform-shaping function on the first scan-line group of the scan-line groups according to the first timing control signal and a first clock signal; and performing the waveform-shaping function on a third scan-line group of the scan-line groups according the first timing control signal and a second clock signal.

3. The power saving method of claim 2 further comprising: performing frequency division on a third clock signal to generate the first clock signal and the second clock signal.

4. The power saving method of claim 1, wherein the step of segregating the scan lines into the scan-line groups comprises:

segregating the scan lines into the scan-line groups according to a plurality of gate drivers.

5. The power saving method of claim 1, wherein the step of segregating the scan lines into the scan-line groups comprises:

segregating the scan lines into the scan-line groups according to a specific scan-line order or a specific quantity of adjacent scan lines.

6. The power saving method of claim 1, wherein the first timing control signal is an input start pulse and the second timing control signal is an output start pulse.

7. A liquid crystal display (LCD) comprising:

a plurality of scan-line groups, wherein each of the scan-line groups comprises a plurality of scan lines, and the scan-line groups comprises a first scan-line group and a second scan-line group;

a plurality of waveform-shaping circuits for individually performing a waveform-shaping function on each of the scan-line groups at different time points, wherein each of the waveform-shaping circuits is coupled to one of the scan-line groups, and the waveform-shaping circuits comprise a first waveform-shaping circuit corresponding to the first scan-line group and a second waveform-shaping circuit corresponding to the second scan-line group, each of the waveform-shaping circuits comprising:

a waveform-shaping unit for performing the waveform-shaping function; and a control logic unit coupled to the waveform-shaping unit, for controlling the waveform-shaping unit to perform the waveform-shaping function, wherein the control logic unit of the first waveform-shaping circuit controls the waveform-shaping unit of the first waveform-shaping circuit to disable the waveform-shaping function on the first scan-line group according to a second timing control signal received by the control logic unit of the first waveform-shaping circuit, the control logic unit of the second waveform-shaping circuit controls the waveform-shaping unit of the second waveform-shaping circuit to enable the waveform-shaping function on the second scan-line group according to a first timing control signal received by the control logic unit of the second waveform-shaping circuit, and the second timing control signal according to which the waveform-shaping function of the first scan-line group is disabled is transmitted from the first waveform-shaping circuit to the second waveform-shaping circuit to serve as the first timing control signal according to which the waveform-shaping function of the second scan-line group is enabled.

8. The LCD of claim 7, wherein the control logic unit comprises:

a flip-flop comprising:

a first input terminal for receiving the first timing control signal a second input terminal for receiving the second timing control signal; and an output terminal for outputting an enable signal;

a first logic gate comprising:

a first input terminal for receiving the enable signal;

a second input terminal couple to a clock signal; and an output terminal for outputting a first switching control signal; and a second logic gate comprising:

a first input terminal for receiving the enable signal;

a second input terminal coupled to the clock signal; and an output terminal for outputting a second switching control signal;

wherein, the first switching control signal and the second switching control signal control the waveform-shaping unit to enable or disable to the waveform-shaping function.

9. The LCD of claim 8, wherein the waveform-shaping unit comprises:

a first switch for turning on or off according to the first switching control signal;

a second switch for turning on or off according to the second switching control signal; and a resistance element.

10. The LCD of claim 8, wherein the waveform-shaping unit comprises:

a first switch for turning on or off according to the first switching control signal;

a second switch for turning on or off according to the second switching control signal; and a current source.

11. The LCD of claim 8, wherein the flip-flop is a D flip flop; the first logic gate is an AND gate; the second logic gate is a NAND gate.

12. The LCD of claim 8, wherein the waveform-shaping circuits individually performing the waveform-shaping function on each of the scan-line groups at the different time points comprises:

the first waveform-shaping circuit of the waveform-shaping circuits performing the waveform-shaping function on the first scan-line group of the scan-line groups according to the first timing control signal and a first clock signal; and a third waveform-shaping circuit of the waving-shaping circuits performing the waveform-shaping function on a third scan-line group of the scan-line groups according to the first timing control signal and a second clock signal.

13. The LCD of claim 12, wherein the second clock signal is generated by dividing the first clock signal.

14. The LCD of claim 7, wherein each of the scan-line groups corresponds to one gate driver.

15. The LCD of claim 7, wherein each of the scan-line groups corresponds to a specific scan-line order or a specific quantity of adjacent scan lines.

16. The LCD of claim 7, wherein the first timing control signal is an input start pulse and the second timing control signal is an output start pulse.

* * * * *